US007954252B2

(12) United States Patent
Mather et al.

(10) Patent No.: US 7,954,252 B2
(45) Date of Patent: Jun. 7, 2011

(54) METHODS AND APPARATUS TO DETERMINE AND USE WELLBORE DIAMETERS

(75) Inventors: James Mather, Gloucestershire (GB); Ashers Partouche, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 317 days.

(21) Appl. No.: 12/234,819

(22) Filed: Sep. 22, 2008

(65) Prior Publication Data

US 2009/0301782 A1 Dec. 10, 2009

Related U.S. Application Data

(60) Provisional application No. 61/059,516, filed on Jun. 6, 2008.

(51) Int. Cl.
*G01B 1/00* (2006.01)

(52) U.S. Cl. ..... 33/544.2; 33/544; 33/304

(58) Field of Classification Search ..... 33/544, 33/544.2, 787–790, 302–304; 60/475–476; 166/134, 374

See application file for complete search history.

(56) References Cited

U.S. PATENT DOCUMENTS

| | | | | | |
|---|---|---|---|---|---|
| 2,771,686 | A * | 11/1956 | Hamontre et al. | ..... | 33/544.3 |
| 2,864,173 | A * | 12/1958 | Castel | ..... | 33/544.2 |
| 3,562,916 | A * | 2/1971 | Duckworth | ..... | 33/788 |
| 3,668,927 | A * | 6/1972 | Howell et al. | ..... | 73/152.13 |
| 3,772,794 | A * | 11/1973 | Hopler, Jr. | ..... | 33/544.2 |
| 3,849,721 | A * | 11/1974 | Calvert | ..... | 324/338 |
| 4,041,780 | A * | 8/1977 | Angehrn | ..... | 73/152.02 |
| 4,343,153 | A * | 8/1982 | Kern et al. | ..... | 60/460 |
| 4,467,526 | A * | 8/1984 | Otte | ..... | 33/304 |
| 4,642,986 | A * | 2/1987 | Chatelin | ..... | 60/474 |
| 4,797,822 | A * | 1/1989 | Peters | ..... | 702/11 |
| 5,092,056 | A * | 3/1992 | Deaton | ..... | 33/544 |
| 5,160,925 | A * | 11/1992 | Dailey et al. | ..... | 340/853.3 |
| 5,358,059 | A * | 10/1994 | Ho | ..... | 175/45 |
| 5,646,611 | A * | 7/1997 | Dailey et al. | ..... | 340/853.6 |
| 5,778,671 | A * | 7/1998 | Bloomquist et al. | ..... | 60/456 |
| 6,065,218 | A * | 5/2000 | Edwards | ..... | 33/544 |
| 6,092,610 | A * | 7/2000 | Kosmala et al. | ..... | 175/61 |
| 6,986,282 | B2 | 1/2006 | Ciglenec et al. | | |
| 7,114,562 | B2 | 10/2006 | Follini et al. | | |
| 7,357,178 | B2 * | 4/2008 | Thornton | ..... | 166/241.6 |
| 7,380,468 | B2 * | 6/2008 | Beaulieu et al. | ..... | 73/861.12 |
| 7,380,597 | B2 * | 6/2008 | Edwards et al. | ..... | 166/250.01 |
| 7,388,380 | B2 * | 6/2008 | Chen et al. | ..... | 324/347 |
| 7,469,748 | B2 * | 12/2008 | Ocalan et al. | ..... | 166/372 |
| 2006/0168955 | A1 * | 8/2006 | Longfield et al. | ..... | 60/473 |
| 2007/0183900 | A1 * | 8/2007 | Ocalan et al. | ..... | 417/1 |
| 2008/0156486 | A1 * | 7/2008 | Ciglenec et al. | ..... | 166/264 |

* cited by examiner

*Primary Examiner* — G. Bradley Bennett
*Assistant Examiner* — Tania C Courson
(74) *Attorney, Agent, or Firm* — David J. Smith; Dave R. Hofman

(57) ABSTRACT

Example methods and apparatus to determine and use wellbore diameters are disclosed. A disclosed example method comprises positioning a downhole tool in a wellbore, counting a number of rotations of a motor used to cause the downhole tool to contact a surface of the wellbore, and determining a diameter of the wellbore based on the number of rotations of the motor.

27 Claims, 6 Drawing Sheets

METHODS AND APPARATUS TO DETERMINE AND USE WELLBORE DIAMETERS

RELATED APPLICATION

This patent claims the benefit of U.S. Provisional Application Ser. No. 61/059,516, entitled "Formation Pressure While Drilling Tool and Method For Use," filed on Jun. 6, 2008, and which is hereby incorporated by reference in its entirety.

FIELD OF THE DISCLOSURE

This disclosure relates generally to wellbores and, more particularly, to methods and apparatus to determine and use wellbore diameters.

BACKGROUND

Wells are generally drilled into the ground to recover natural deposits of hydrocarbons and/or other desirable materials trapped in geological formations in the Earth's crust. A well is drilled into the ground and/or directed to a targeted geological location and/or geological formation by a drilling rig at the Earth's surface.

SUMMARY

Example methods and apparatus to determine and use wellbore diameters are disclosed. The diameter of a well drilled into a formation (i.e., a wellbore) may be affected by the stability of the formation through which the wellbore is drilled. An unstable formation may result in a wellbore of varying diameter due to, for example, a borehole washout. Borehole washouts may, for example, prevent a sampling probe from properly, completely or adequately sealing against a wall of the wellbore during a fluid sampling operation.

The example methods and apparatus disclosed herein use the distance that a backup piston and/or a probe-setting piston of a downhole tool is extended to bring a sampling probe in contact with the wall of the wellbore to measure, compute or otherwise determine the diameter of the wellbore. To measure the amount of backup piston extension, the examples described herein count the number of rotations or turns of a motor used to operate a hydraulic pump that extends the piston. The wellbore diameter can be determined using the counted number of rotations. The extent of backup piston extension and/or extent of probe-setting piston extension can, additionally or alternatively, be determined and/or measured using position sensors such as, for example, a linear variable differential transformer (LVDT), a potentiometer, a magnetic sensor, etc.

As further described herein, extent of backup piston extension, extent of probe-setting piston extension and/or the diameter of a wellbore can be used to determine whether a sampling probe is likely to achieve a sufficient seal with the wall of a wellbore. In particular, when a particular portion of the wellbore is larger than other portions of the wellbore and/or is beyond the wellbore diameter measuring capability of a downhole tool, it is likely that a wellbore washout has occurred. When such a washout is detected, the downhole tool can be re-positioned within the wellbore before a sampling operation is initiated.

A disclosed example method includes positioning a downhole tool in a wellbore, counting a number of rotations of a motor used to cause the downhole tool to contact a surface of the wellbore, and determining a diameter of the wellbore based on the number of rotations of the motor.

A disclosed example downhole tool for operation in a wellbore includes a probe assembly positioned on a first side of the downhole tool, a piston positioned on a second side of the downhole tool, the second side opposite the first side, a motor to operate to position the piston to cause the probe assembly to contact a surface of the wellbore, a counter to count a number of rotations of the motor used to position the piston, and a processor to determine a diameter of the wellbore using the number of rotations of the motor.

Another disclosed example method includes positioning a tool in a wellbore, the tool having an extendable piston, determining how far the piston is extended towards a surface of the wellbore, determining, based on how far the piston is extended, an indication of a probe seal failure, and repositioning the tool in the wellbore when the determined indication represents a probable probe seal failure.

Certain examples are shown in the above-identified figures and described in detail below. In describing these examples, like or identical reference numbers may be used to identify common or similar elements. The figures are not necessarily to scale and certain features and certain views of the figures may be shown exaggerated in scale or in schematic for clarity and/or conciseness.

DETAILED DESCRIPTION

While example methods and apparatus are described herein with reference to so-called "sampling-while-drilling," "logging-while-drilling," and/or "measuring-while drilling" operations, the example methods and apparatus may, additionally or alternatively, be used to determine wellbore diameters, and/or to use wellbore diameters to determine whether re-position a downhole tool and/or to initiate a sampling operation during a wireline sampling operation.

Figure 1:
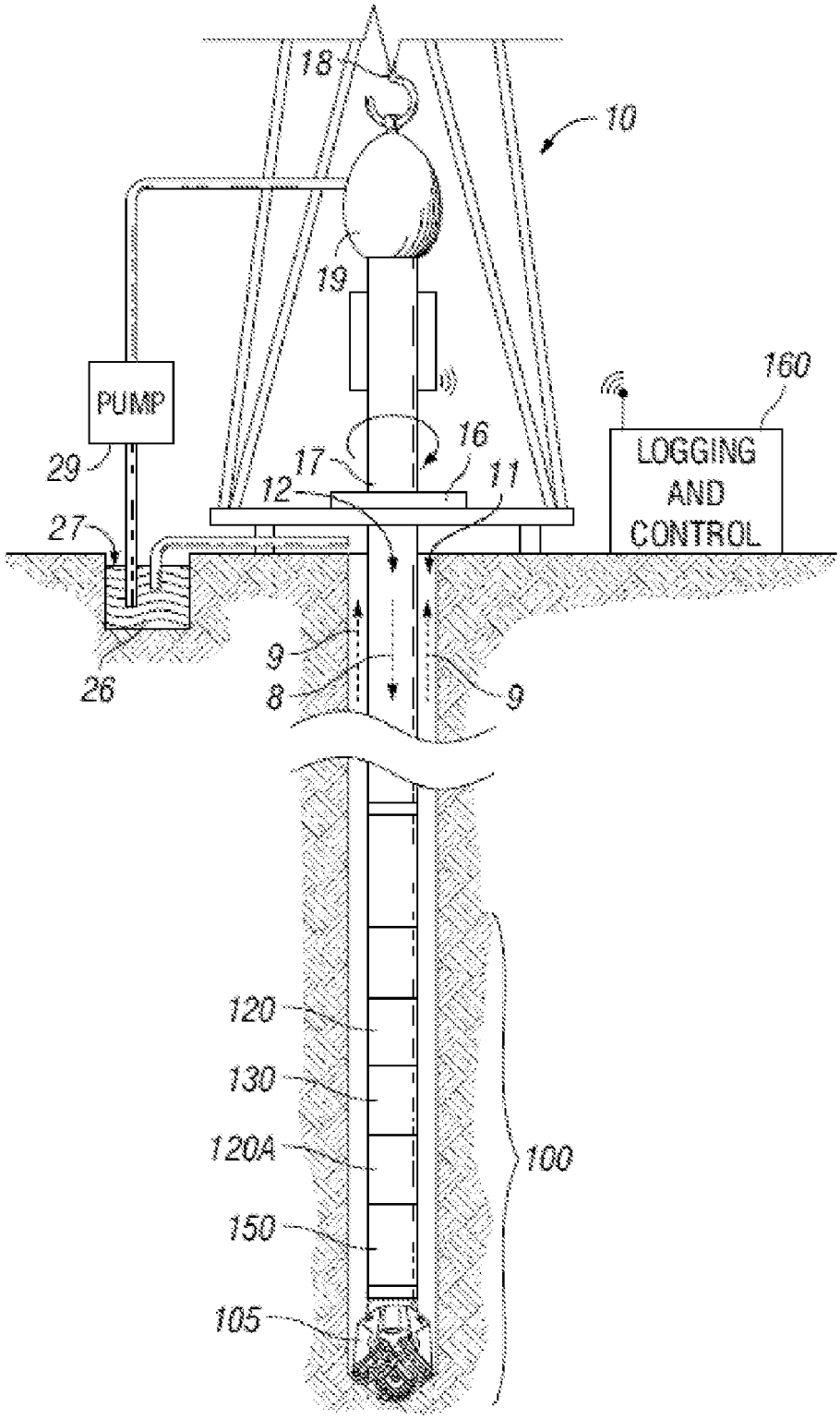
FIG. 1 PRIOR ART
FIG. 1 illustrates an example wellsite drilling system of the prior art, and within which the example methods and apparatus described herein may be implemented.

FIG. 1 illustrates an example wellsite drilling system that can be employed onshore and/or offshore. In the example wellsite system of FIG. 1, a borehole 11 is formed in one or more subsurface formations by rotary and/or directional drilling.

As illustrated in FIG. 1, a drill string 12 is suspended within the borehole 11 and has a bottom hole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drill string 12 is rotated by the rotary table 16, energized by means not shown, which engages the kelly 17 at the upper end of the drill string 12. The example drill string 12 is suspended from the hook 18, which is attached to a traveling block (not shown), and through the kelly 17 and the rotary swivel 19, which permits rotation of the drill string 12 relative to the hook 18. Additionally or alternatively, a top drive system could be used.

In the example of FIG. 1, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer on the walls of the borehole 11.

The example BHA 100 of FIG. 1 includes, among other things, any number and/or type(s) of logging-while-drilling (LWD) modules (two of which are designated at reference numerals 120 and 120A) and/or measuring-while-drilling (MWD) modules (one of which is designated at reference numeral 130), a roto-steerable system or mud motor 150, and the example drill bit 105.

The example LWD modules 120 and 120A of FIG. 1 are each housed in a special type of drill collar, as it is known in the art, and each contain any number of logging tools and/or fluid sampling devices. The example LWD modules 120, 120A include capabilities for measuring, processing, and/or storing information, as well as for communicating with surface equipment, such as a logging and control computer 160 via, for example, the MWD module 130.

An example manner of implementing a pumping system 230 for any of the LWD modules 120, 120A, which can determine a wellbore diameter by counting rotations of a motor 336 used to drive a hydraulic pump 335 to operate a backup piston 225, is described below in connection with FIGS. 2 and 3. Additionally or alternatively, the pumping system 230 can determine a wellbore diameter by counting rotations of a motor 336 used to drive a hydraulic pump 335 to operate one or more probe-setting pistons 207 associated with a probe 205. While the methods disclosed herein are described in connection with the example pumping system 230, any other method(s) and/or apparatus may be used to drive the backup piston 225 and/or the probe-setting piston(s) 207. For example, a wellbore diameter may be determined by counting rotations of, for example, one or more screw threads used to deploy and/or drive the backup piston 225 and/or the probe-setting piston(s) 207. As described below in connection with FIG. 7, an extent of backup piston extension, an extent of probe-setting piston extension, and/or the diameter of a wellbore can be used by, for example, the logging and control computer 160 to determine whether a LWD module 120, 120A should be repositioned within the wellbore before initiating a fluid sampling operation. In some examples, the example methods and apparatus described herein to measure, compute and/or otherwise determine wellbore diameter and/or wellbore rugosity are used to calibrate, test and/or validate other methods and/or devices that measure wellbore diameter and/or rugosity.

Other example manners of implementing an LWD module 120, 120A are described in U.S. Pat. No. 7,114,562, entitled "Apparatus and Method For Acquiring Information While Drilling," and issued on Oct. 3, 2006; and in U.S. Pat. No. 6,986,282, entitled "Method and Apparatus For Determining Downhole Pressures During a Drilling Operation," and issued on Jan. 17, 2006. U.S. Pat. No. 7,114,562, and U.S. Pat. No. 6,986,282 are hereby incorporated by reference in their entireties.

The example MWD module 130 of FIG. 1 is also housed in a special type of drill collar and contains one or more devices for measuring characteristics of the drill string 12 and/or the drill bit 105. The example MWD tool 130 further includes an apparatus (not shown) for generating electrical power for use by the downhole system. Example devices to generate electrical power include, but are not limited to, a mud turbine generator powered by the flow of the drilling fluid, and a battery system. Example measuring devices include, but are not limited to, a weight-on-bit measuring device, a torque measuring device, a vibration measuring device, a shock measuring device, a stick slip measuring device, a direction measuring device, and an inclination measuring device.

Figure 2:
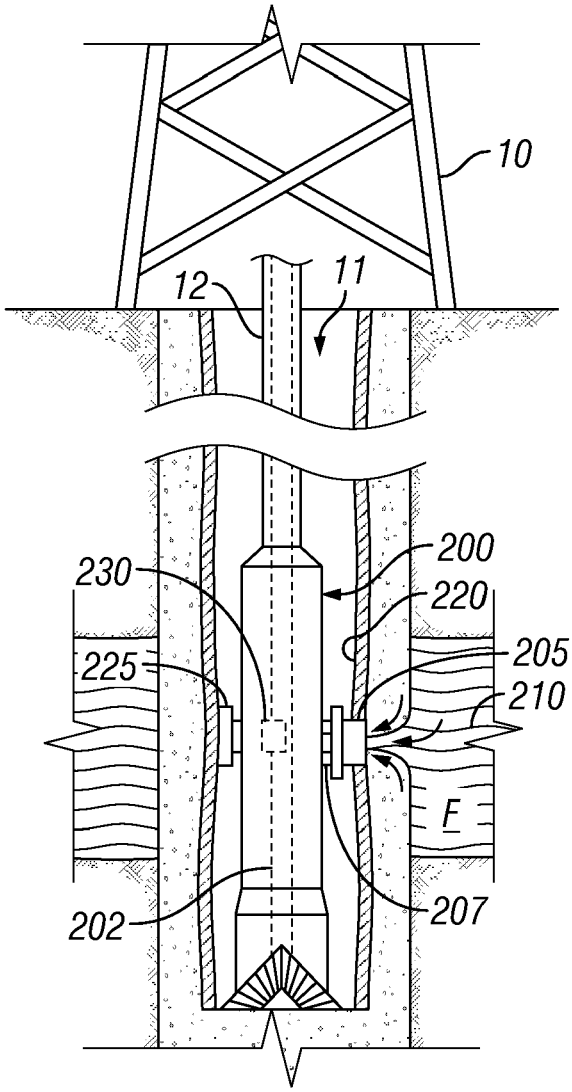
FIG. 2 illustrates an example manner of implementing either or both of the example logging while drilling (LWD) modules of FIG. 1.

FIG. 2 is a schematic illustration of an example manner of implementing either or both of the example LWD modules 120 and 120A of FIG. 1. While either of the example LWD modules 120 and 120A of FIG. 1 may be implemented by the example device of FIG. 2, for ease of discussion, the example device of FIG. 2 will be referred to as LWD module 200. The example LWD module 200 of FIG. 2 may be used to obtain fluid samples and/or measure one or more properties of a fluid and/or formation. The example LWD module 200 is attached to the drill string 12 driven by the rig 10 to form the wellbore or borehole 11. When the LWD module 200 is part of a drill string, the LWD module 200 includes a passage 202 to permit drilling mud to be pumped through the LWD module 200 to remove cuttings away from a drill bit.

The example LWD module 200 of FIG. 2 is provided with a probe 205 for establishing fluid communication with a formation F and to draw a fluid 210 into the LWD module 200, as indicated by the arrows. The example probe 205 of FIG. 2 may be positioned, for example, within a stabilizer blade (not shown) of the LWD module 200 and extended from the stabilizer blade by one or more probe-setting pistons (one of which is designated at reference numeral 207) to engage a borehole wall 220. Fluid 210 drawn into the LWD module 200 using the probe 205 may be measured to determine, for example, pretest and/or pressure parameters. Additionally, the LWD module 200 may be provided with devices, such as fluid analyzers and/or sample chambers (not shown), for analyzing, characterizing and/or collecting fluid samples for transmission to and/or retrieval at the surface.

To apply force to push the LWD module 200 and/or the probe 205 against the borehole wall 220, the example LWD module 200 of FIG. 2 includes one or more backup pistons (one of which is designated at reference numeral 225) and the pumping system 230. The example pumping system 230 of FIG. 2 is controllable and/or operable to extend and retract the backup piston 225 to push the probe 205 into engagement with the borehole wall 220. For example, the backup piston 225 pushes or drives a side of the LWD module 200 opposite the backup piston 225 against the wall 220. Once the backup piston 225 has driven the LWD module 220 against the borehole wall 220, one or more probe-setting pistons 207 extends the probe 205 into contact the borehole wall 220 with sufficient pressure to seal the probe 205 against the wall 220. As described below in connection with FIG. 3, the example pumping system 230 includes a resolver or other counting device to count rotations of a motor used to operate a hydraulic pump that extends and retracts the backup piston 225. The number of rotations used to move the backup piston 225 from an at-rest position to another position where the LWD module 200 contacts and/or presses against the borehole wall 220 is used to measure, compute and/or otherwise determine the diameter of the wellbore 11 in the vicinity of the LWD module 200. In some examples, the extent of probe-setting piston movement is also used to measure, compute and/or otherwise determine the diameter of the wellbore 11. For example, the extent of probe-setting piston extension can be used to detect small washouts that are not detectable based on amount of extension of the backup piston 220. Such small washouts are indicative and/or representative of rugosity of the wellbore 11. The extent of backup piston extension and/or extent of probe-setting piston extension may be determined and/or measured using position sensors such as, for example, a linear variable differential transformer (LVDT), a potentiometer, a magnetic sensor, etc. An example manner of implementing the example pumping system 230 of FIG. 2 is described below in connection with FIGS. 3, 4A and 4B.

Figure 3:
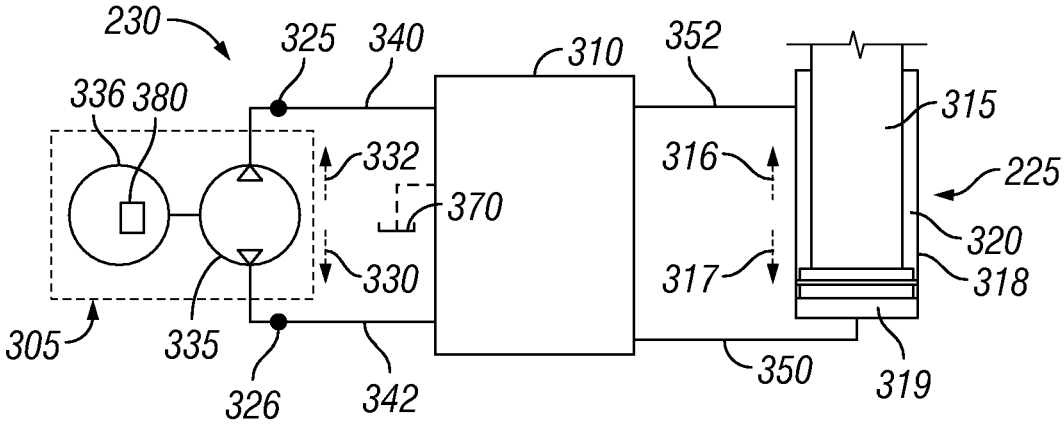
FIG. 3 illustrates an example manner of implementing the example pumping system of FIG. 2.

FIG. 3 illustrates an example manner of implementing the example pumping system 230 of FIG. 2. While the example pumping system 230 of FIG. 3 drives one backup piston 225, the pumping system 230 could be used to drive two or more backup pistons. To operate (e.g., move) the backup piston 225, the example pumping system 230 of FIG. 2 includes a fluid movement source 305 and any type of passive flow distribution block 310 that operate cooperatively to form a hydraulic pumping circuit. The example backup piston 225 of FIG. 3 has a moveable body 315 capable of moving in at least two directions such as a first direction 316 and a second direction 317. The example moveable body 315 of FIG. 3 is disposed in or on a vessel 318 and is moved in the direction 316 and the direction 317 by fluid pressure. The example moveable body 315 can be any type of device moved by fluid pressure, such as a piston or pump. The moveable body 315 and the vessel 318 can take a variety of forms so long as the moveable body 315 can be moved relative to the vessel 318 due to fluid pressure. For example, the moveable body 315 can be a piston or a valve with the moveable body 315 and the vessel 318 being cylindrically shaped. In an example, the moveable body 315 is slidably positionable in the vessel 318 with the moveable body 315 defining a first chamber 319 and a second chamber 320 in the vessel 318.

The example fluid movement source 305 of FIG. 3 moves fluid within the pumping system 230 in at least two directions. The fluid can be hydraulic fluid, borehole fluid, or formation fluid and/or combinations thereof. The example fluid movement source 305 has at least two ports 325 and 326. In one example mode of operation, the fluid movement source 305 is adapted to move fluid within the pumping system 230 in a direction 330, and the port 325 serves as an inlet to the fluid movement source 305 and the port 326 serves as an outlet to the fluid movement source 305. In another example mode of operation, the fluid movement source 305 is adapted to move fluid within the pumping system 230 in a direction 332 generally opposite to the direction 330. In this mode, the example port 326 serves as an inlet to the fluid movement source 305, and the example port 325 serves as an outlet to the fluid movement source 305.

The example fluid movement source 305 of FIG. 3 includes the bi-directional pump 335 driven by the motor 336. When the example motor 336 turns in one direction (e.g., clockwise) the motor 336 drives the pump 335 to pump fluid in the direction 332 toward the port 325. Likewise when the motor 336 turns in another direction (e.g., counter-clockwise) the motor 336 drives the pump 335 to pump fluid in the direction 330 toward the port 326. Thus, by controlling the direction in which the pump 336 rotates, fluid can be pumped in either the direction 330 or the direction 332. While the example fluid movement source 305 of FIG. 3 includes a single motor 336 and a single pump 335, a fluid movement source 305 may contain any number of motors and/or pumps configurable to pump fluid in the direction 330 and the direction 332. Moreover, a fluid movement source 305 may be implemented with a uni-directional pump and flow control components (e.g., solenoid valves) that allow the direction of fluid flow to be changed.

The passive flow distribution block 310 of FIG. 3 connects the fluid movement source 305 to the backup piston 225 such that upon the fluid movement source 305 moving fluid in one direction (e.g. the direction 330), fluid is diverted into the first chamber 319 and the moveable body 315 of the backup piston 225 is moved in the direction 316, and upon the fluid movement source 305 moving fluid in another direction (e.g. the direction 332), fluid is diverted into the second chamber 320 and the moveable body 315 of the backup piston 225 is moved in the direction 317. In general, the passive flow distribution block 310 is connected (1) to the fluid movement source 305 via flow lines 340 and 342, and (2) to the backup piston 225 via flow lines 350 and 352. Example manners of implementing the example passive flow distribution block 305 is described in U.S. Patent Publication No. 2006/0168955, entitled "Apparatus For Hydraulically Energizing Down Hole Mechanical Systems," and published on Aug. 3, 2006. U.S. Patent Publication No. 2006/0168955 is hereby incorporated by reference in its entirety.

The example passive flow distribution block 310 of FIG. 3 also compensates for differences in flow from the opposing sides of the moveable body 315. When the example motor 336 is rotating clockwise, for example, to move fluid in the direction 330 into the first chamber 319 to extend the moveable body 315 in the direction 316, the pump 335 needs to provide more fluid through the flow line 350 to extend the moveable body 315 than it receives from the flow line 352 due to the difference in actuation area on either side of the moveable body 315. When the moveable body 315 is moving, the difference in actuation area translates into a different rate of volume change in the first and second chambers 319 and 320. When the moveable body 315 is extending, the flow line 342 has a higher pressure than the flow line 340, and the example passive flow distribution block 310 of FIG. 3 supplements the fluid needed at the inlet (port 325) of the pump 335 by supplying additional fluid from a reservoir 370 into the flow line 340. A movable piston, bellows or membrane (not shown) is positioned within the reservoir 370. The example reservoir 370 of FIG. 3 communicates with the wellbore 11 via a flow line (not shown). The reservoir piston and the flow line equalize pressure between the local mud hydrostatic pressure within the wellbore 11 and the pressure in the reservoir 370.

While retracting the moveable body 315 (i.e., moving the body 315 in the direction 317) the opposite occurs. Specifically, the example pump 335 receives more fluid from the first chamber 319 (extend side of the body 315) than it needs to supply to the second chamber 320 (retract side of the body 315) to retract the moveable body 315. In this case, the passive flow distribution block 310 changes state, based on the difference in pressure between the flow line 340 and the flow line 342, to allow the excess fluid to flow back to the reservoir 370.

Fluid flow is distributed by the example passive flow distribution block 310 such that the force acting on the moveable body 315 is not diminished by pressure on the opposing side. In particular, the passive flow distribution block 310 is implemented to equalize both sides of the moveable body 315 to reservoir pressure so that the full force of the pump 335 is transmitted and not cancelled by trapped pressure on either side of the moveable body 315.

To determine the distance that the moveable body 315 has extended or retracted, the example fluid movement source 305 includes a rotation counter or sensor 380. An example rotation sensor 380 comprises a resolver 380 implemented in conjunction with the motor 336 and configurable to count rotations of the motor 336. Another example rotation sensor 380 comprises a motor control module 380 configurable to determine a speed of the motor 336 and to determine (e.g., compute) rotations of the motor 336 based on the speed. For instance, the example motor control module 380 controls the speed of the motor 336 by adjusting the firing angle of the motor 336 at particular time intervals and/or at a particular frequency. The frequency at which the firing angle is adjusted may be used to determine the speed of the motor 336. The determined motor speed may be used to increment a motor turn counter. Additionally or alternatively, motor rotations may be computed by, for example, computing an integral of motor speed. As described below in connection with FIGS. 5 and 6, the number of rotations of the motor 336 required to extend the moveable body 315 from an at-rest position to a second position at which the example probe 205 of FIG. 2 contacts the wellbore wall 220 is related to and/or can be used to determine the diameter of the wellbore 11. When started, the example resolver 380 of FIG. 3 resets its count to zero and begins counting rotations of the motor 336. When stopped, the number of rotations of the motor 336 counted by resolver 380 is, for example, stored in the example LWD module 200 of FIG. 2 for later retrieval and/or transmitted to the surface via any type of telemetry communication protocol and/or technology.

Figure 4:
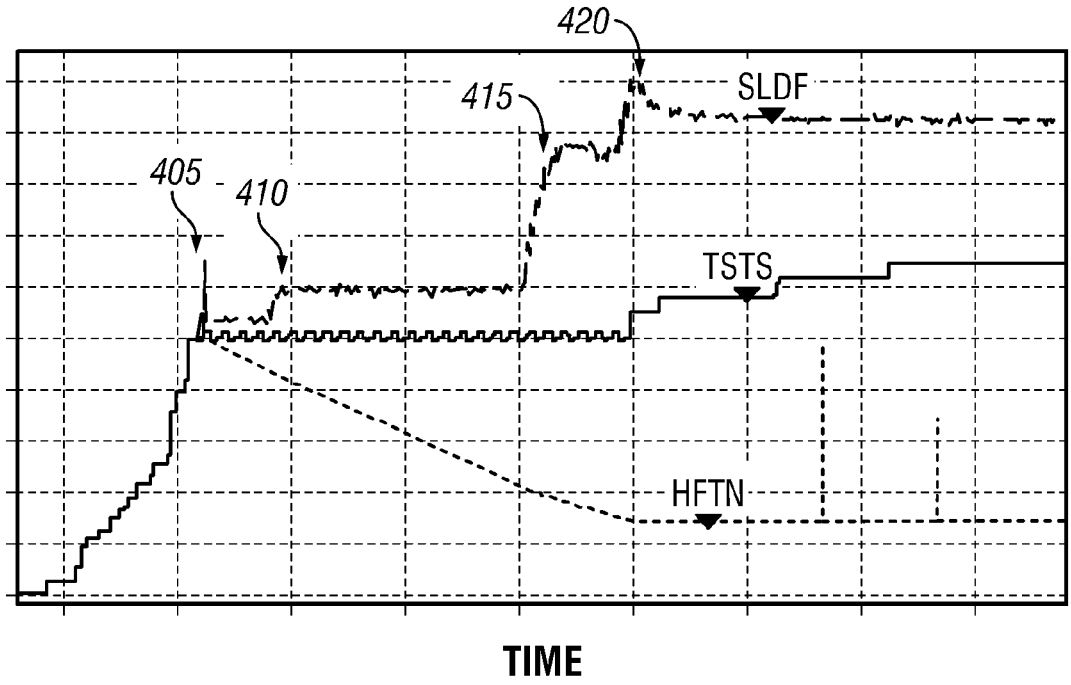
FIG. 4 is a graph characterizing an example operation of the example pumping system of FIG. 2.

FIG. 4 is a graph illustrating an example operation of the example LWD module 200 of FIG. 2. In the illustrated example of FIG. 2, hydraulic pump motor turns (HFTN) includes both the rotations of the motor 336 that extend the moveable body 315 and the additional rotations of the motor 336 until the probe assembly 205 deploys. As illustrated in FIG. 4, starting at a time 405 the motor 336 beings rotating. As the motor 336 continues to rotate, the moveable body 315 begins extending at a time 410 as evidenced by the rise in set line differential pressure (SLDF). When the probe assembly 205 comes into sufficient contact with the wellbore wall 220 at time 415 (e.g., when a check valve triggers the deployment of the probe 205), the probe assembly 205 beings to deploy reaching full compression and seal with the wellbore wall 220 at time 420. As shown in FIG. 4, the backup piston 225 begins to extend when the SLDF reaches approximately 500 pounds per square inch (psi), probe assembly 205 deployment begins in the range of 1800 psi to 1900 psi, and full probe compression occurs at approximately 2500 psi. Based on the example operation illustrated in FIG. 4 and laboratory experiments, an SLDF of at least 1750 psi represents a reliable threshold for detecting when probe assembly 205 deployment is beginning and rotations of the motor 336 are substantially proportional to wellbore diameter.

Figure 5:
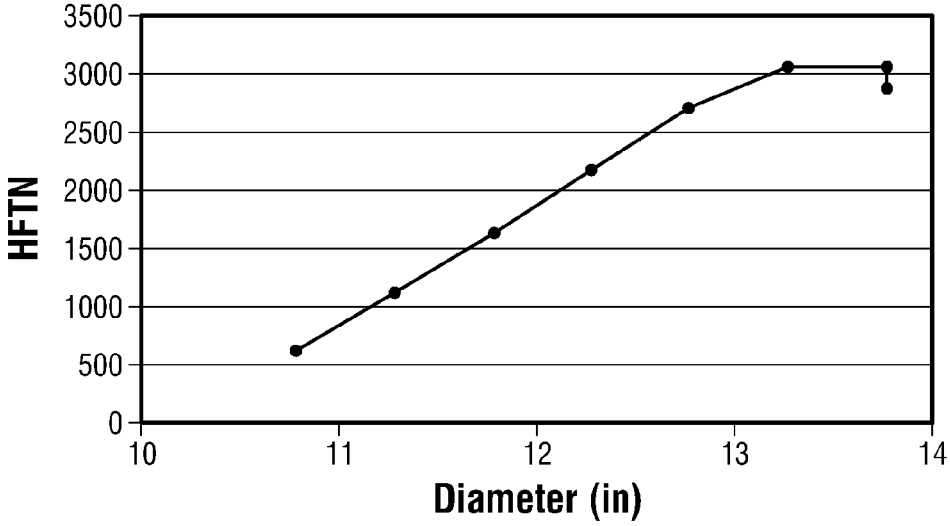
FIG. 5 is a graph of an example relationship between motor turns and wellbore diameter.

FIG. 5 is a graph illustrating an example relationship between HFTN and wellbore diameter, assuming that HFTN are counted until SLDF exceeds 1750 psi as described above in connection with FIG. 4. As shown in FIG. 5, HFTN and wellbore diameter are approximately linearly related. While the example relationship of FIG. 5 is illustrated as a graph, the relationship of FIG. 5 may be expressed and/or represented as a table and/or mathematical expression that may be used by, for example, the example processor P105 of FIG. 8 to compute or determine a wellbore diameter using HFTN. The example relationship of FIG. 5 is physically limited in the low diameter direction by the outside diameter of the LWD module 200. The example relationship is physically limited in the high diameter direction by the stroke of the piston 225. Various ways of determining the example data represented in FIG. 5 may be used, including, for example, extending the piston 225 in a set of casings having known diameters. In some examples, the relationship of HFTN and wellbore diameter is determined at pressure(s) and/or temperature(s) encountered during in situ usage.

Figure 6:
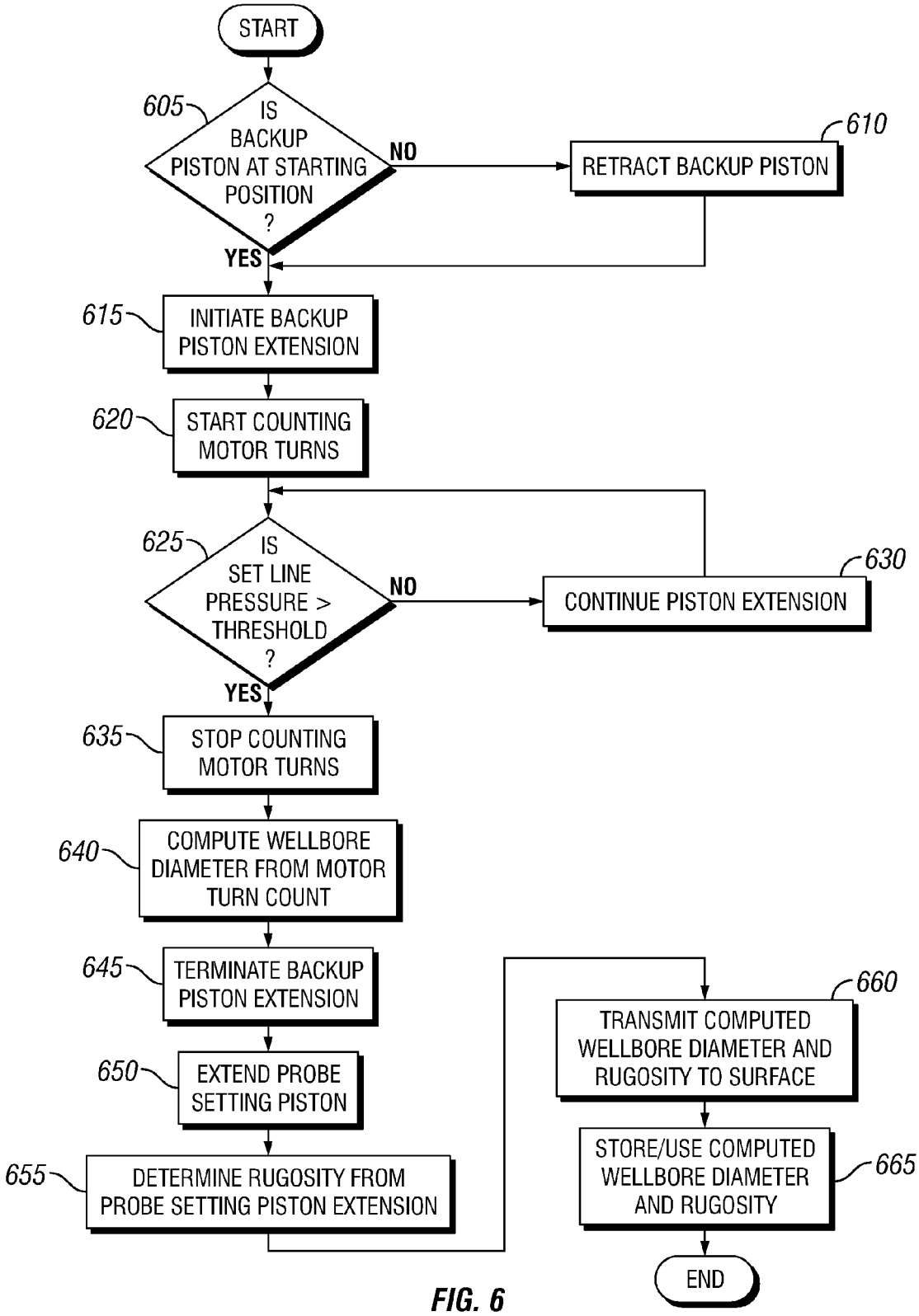
FIG. 6 is a flowchart representative of example processes that may be executed by, for example, a processor to determine the diameter of a wellbore.
Figure 7:
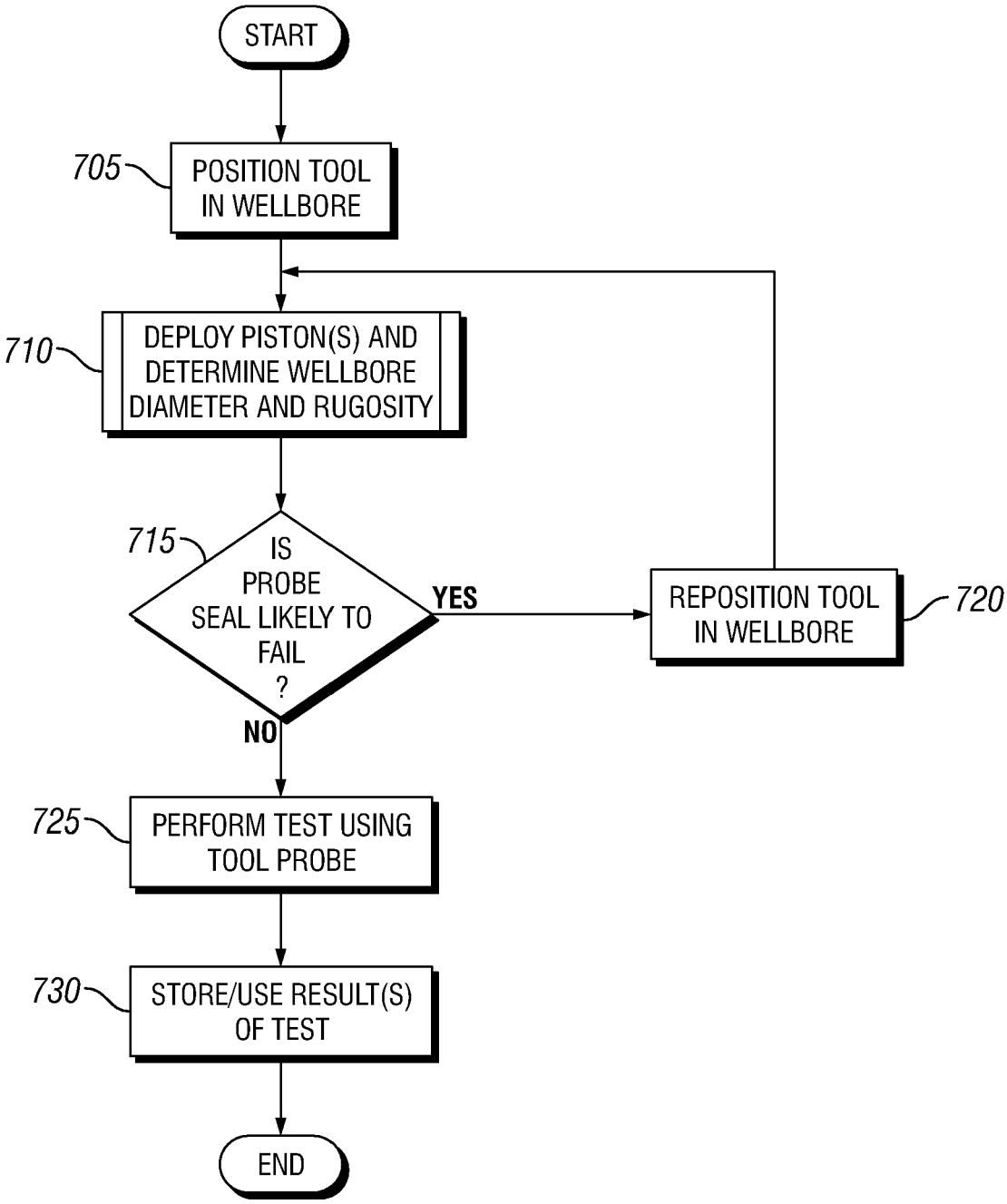
FIG. 7 is a flowchart representative of example processes that may be executed by, for example, a processor to determine whether to reposition a downhole tool.

FIG. 6 illustrates an example processes that may be carried out to determine the diameter of a wellbore using a count of rotations of a motor used to turn a hydraulic pump to operate a backup piston of a downhole tool. FIG. 7 illustrates an example process that may be carried out to determine whether to initiate a fluid sampling operation based on wellbore diameter. The example processes of FIGS. 6 and/or 7 may be carried out by a processor, a controller and/or any other suitable processing device. For example, the processes of FIGS. 6 and/or 7 may be embodied in coded instructions stored on a tangible medium such as a flash memory, a read-only memory (ROM) and/or random-access memory (RAM) associated with a processor (e.g., the example processor P105 discussed below in connection with FIG. 8). Alternatively, some or all of the example processes of FIGS. 6 and/or 7 may be implemented using any combination(s) of circuit(s), application specific integrated circuit(s) (ASIC(s)), programmable logic device(s) (PLD(s)), field-programmable logic device(s) (FPLD(s)), discrete logic, hardware, firmware, etc. Also, some or all of the example processes of FIGS. 6 and/or 7 may be implemented manually or as any combination of any of the foregoing techniques, for example, any combination of firmware, software, discrete logic and/or hardware. Further, although the example operations of FIGS. 6 and/or 7 are described with reference to the flowcharts of FIGS. 6 and/or 7, many other methods of implementing the operations of FIGS. 6 and/or 7 may be employed. For example, the order of execution of the blocks may be changed, and/or one or more of the blocks described may be changed, eliminated, subdivided, or combined. Additionally, any or all of the example processes of FIGS. 6 and/or 7 may be carried out sequentially and/or carried out in parallel by, for example, separate processing threads, processors, devices, discrete logic, circuits, etc.

The example process of FIG. 6 begins with the pumping system 230 determining whether the backup piston 225 is at its at-rest or starting location (block 605). If the backup piston 225 is not at its at-rest position (block 605), the motor 336 is rotated until the moveable body 315 is fully retracted (block 610).

When the backup piston 225 is at its at-rest position (block 605), extension of the piston 225 is initiated (block 615) and the example resolver 380 of FIG. 3 starts counting rotations of the motor 336 (i.e., HFTN) (block 620). While the set-line pressure (SLDF) is less than a threshold (e.g., 1750 psi) (block 625), the motor 336 continues to rotate to extend the moveable body 315 (block 630).

When the SLDF exceeds the threshold (block 625), the resolver 380 stops counting rotations of the motor 336 (block 635), the counted number of rotations of the motor 336 is used by a processor implemented in the LWD module 200 to determine the diameter of the wellbore 11 using, for example, the example relationship of FIG. 5 (block 640), and rotation of the motor 336 is stopped (block 645). Alternatively, the extension of the backup piston can be determined by measured an output of a LVDT, a potentiometer and/or a magnetic sensor, and the determined backup piston extension used to determine the wellbore diameter.

The probe-setting piston(s) 207 extend the probe into sealing contact with the wellbore wall 220 (block 650). The rugosity of the wellbore wall 220 is determined based on the extent of probe-setting piston extension (block 655). The probe-setting piston extension can be measuring using, for example, a LVDT, a potentiometer and/or a magnetic sensor.

The computed wellbore diameter and wellbore rugosity are transmitted to the surface (block 660) and the wellbore diameter and rugosity are stored either at the surface and/or within the LWD module 200 (block 665). Additionally or alternatively, the counted number of rotations of the motor 336 and probe-setting piston extension is transmitted to the surface, where a processor of the example surface computer 160 determines the diameter of the wellbore 11. Control then exits from the example process of FIG. 6.

The example process of FIG. 7 begins when the example LWD module 200 is positioned within a wellbore and a sampling operation is initiated (block 705). The example backup piston 225 and the probe-setting piston(s) 207 are deployed, and the diameter and rugosity of the wellbore 11 at the LWD module 200 is determined by, for example, carrying out the example process of FIG. 6 (block 710). If the extent of backup piston extension, the extent of probe-setting piston extension, the determined wellbore diameter and/or the determined rugosity indicate that the probe 205 is unlikely to properly seal against the wellbore wall 220 (block 715), the LWD module 200 is repositioned (block 720) and control returns to block 710 to determine the wellbore diameter at the new position. For example, the wellbore diameter may be compared with other wellbore diameters to determine if a seal is likely to be successful. For instance, if the wellbore diameter is significantly larger than another nearby wellbore diameter it is probably that a wellbore washout has occurred and a proper probe seal is not likely.

If it is likely that an adequate probe seal can be achieved (block 715), one or more fluid and/or formation tests are performed (block 725), and the results are stored and/or used (block 730). Control then exits from the example process of FIG. 7.

Figure 8:
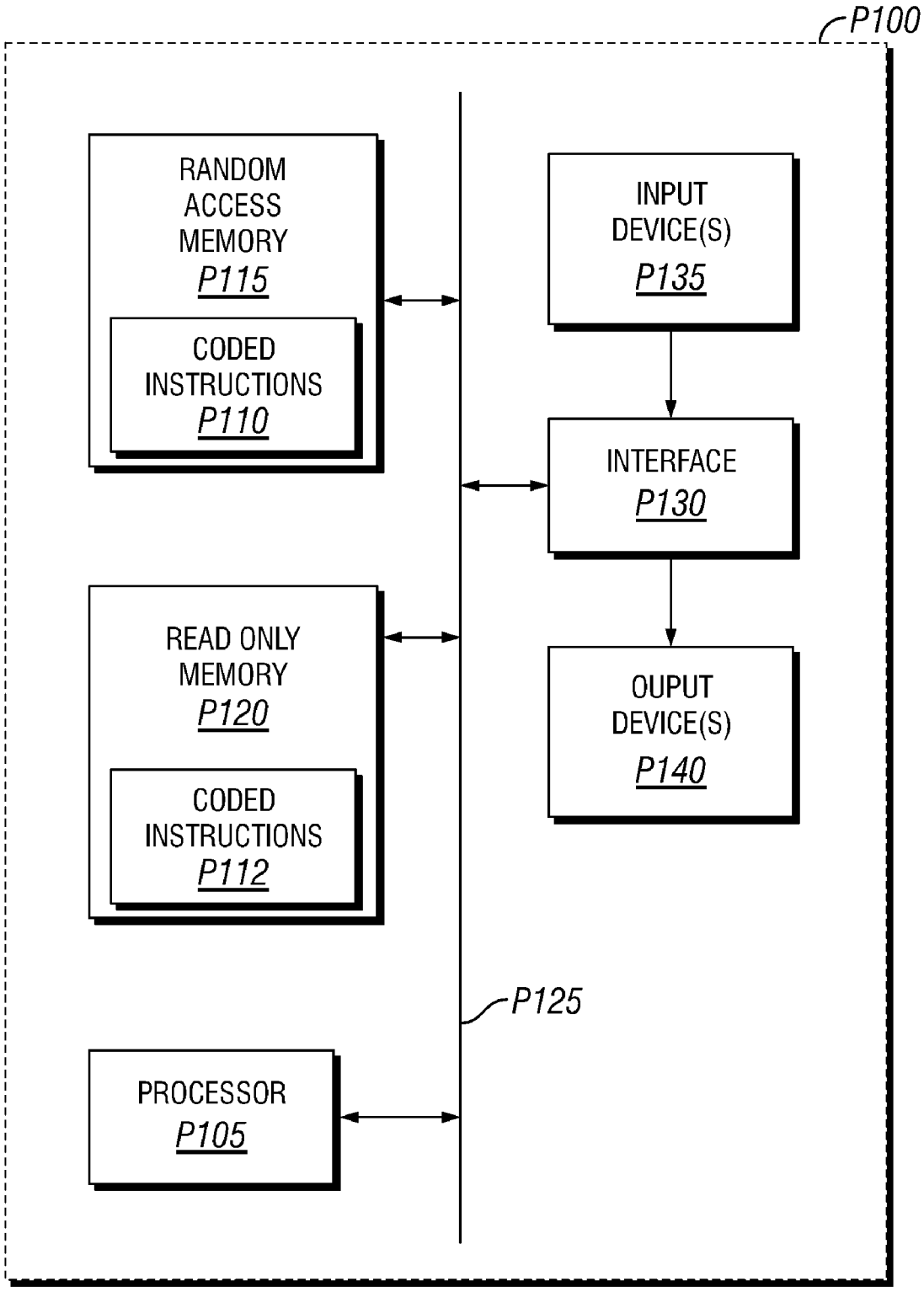
FIG. 8 is a schematic illustration of an example processor platform that may be used and/or programmed to carry out the example processes of FIGS. 6 and/or 7 to implement any of all of the example methods and apparatus described herein.

FIG. 8 is a schematic diagram of an example processor platform P100 that may be used and/or programmed to implement any or all of the example methods and apparatus disclosed herein. For example, the processor platform P100 can be implemented by one or more general-purpose processors, processor cores, microcontrollers, etc.

The processor platform P100 of the example of FIG. 8 includes at least one general-purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example processes of FIGS. 6 and/or 7 to implement the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general purpose input/output, etc. One or more input devices P135 and one or more output devices P140 are connected to the interface circuit P130.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method comprising:

positioning a downhole tool in a wellbore, wherein the downhole tool comprises an internal motor, and wherein rotational operation of the motor is configured to cause the downhole tool to contact a surface of the wellbore;

counting a number of rotations of the motor as the motor is used to cause the downhole tool to contact the surface of the wellbore; and determining a diameter of the wellbore based on the number of rotations of the motor.

2. A method as defined in claim 1, wherein rotations of the motor operate a hydraulic pump to cause the downhole tool to contact the surface of the wellbore.

3. A method as defined in claim 2, further comprising:

measuring a pressure associated the hydraulic pump; and counting the number of rotations of the motor until the pressure exceeds a threshold.

4. A method as defined in claim 3, wherein the threshold is associated with a piston deployment of a probe assembly against the surface of the wellbore.

5. A method as defined in claim 1, wherein the number of rotations is associated with a lateral extension of a piston from an at-rest position to a second position at which the downhole tool contacts the surface of the wellbore.

6. A method as defined in claim 1, wherein a piston is on a first side of the downhole tool, and a second side of the downhole tool opposite the first side contacts the surface of the wellbore when the piston is extended.

7. A method as defined in claim 1, wherein downhole tool comprises a logging-while-drilling tool.

8. A method as defined in claim 1, further comprising determining, based on the determined borehole diameter, whether a probe seal failure is attributable to a borehole washout.

9. A method as defined in claim 8, further comprising repositioning the downhole tool in the wellbore based on the determination of whether the seal failure is attributable to a borehole washout.

10. A downhole tool for operation in a wellbore, the tool comprising:

a probe assembly positioned on a first side of the downhole tool;

a piston positioned on a second side of the downhole tool, the second side opposite the first side;

a motor to operate to position the piston to cause the probe assembly to contact a surface of the wellbore;

a counter to count a number of rotations of the motor used to position the piston; and a processor to determine a diameter of the wellbore using the number of rotations of the motor.

11. A downhole tool as defined in claim 10, wherein the counter comprises a resolver.

12. A downhole tool as defined in claim 10, wherein the counter comprises a motor control module to estimate a speed of the motor and to count the number of rotations based on the speed of the motor.

13. A downhole tool as defined in claim 10, further comprising:

a hydraulic pump to position the piston in response to the rotations of the motor.

14. A downhole tool as defined in claim 10, wherein the motor is to laterally extend the piston from an at-rest position to a second position at which the probe assembly contacts the surface of the wellbore.

15. A downhole tool as defined in claim 10, wherein downhole tool comprises a logging-while-drilling tool.

16. A method comprising:

positioning a tool in a wellbore, the tool having an extendable piston;

determining how far the piston is extended towards a surface of the wellbore;

determining, based on how far the piston is extended, an indication of a probe seal failure; and repositioning the tool in the wellbore when the determined indication represents a probable probe seal failure.

17. A method as defined in claim 16, wherein the piston extends a probe from the tool, and wherein the probable probe seal failure represents a rugosity of the wellbore.

18. A method as defined in claim 16, wherein the piston comprises a backup piston extended towards the surface of the wellbore to bring a probe into contact with a second surface of the wellbore.

19. A method as defined in claim 16, wherein determining how far the piston is extended comprises measuring an output of at least one of a linear variable differential transformer (LVDT), a potentiometer, or a magnetic sensor.

20. A method as defined in claim 16, wherein determining how far the piston is extended comprises counting a number of rotations of a motor that extends the piston.

21. A method as defined in claim 20, further comprising determining the diameter of the wellbore based on the number of rotations of the motor, wherein the indication of the probe seal is determined based on the diameter of the wellbore.

22. A method as defined in claim 20, wherein the motor rotates to operate a hydraulic pump that extends the piston.

23. A method as defined in claim 22, further comprising:

measuring a pressure associated the hydraulic pump; and counting the number of rotations of the motor until the pressure exceeds a threshold.

24. A method as defined in claim 20, wherein the number of rotations is associated with a lateral extension of a piston from an at-rest position to a second position at which the downhole tool contacts the surface of the wellbore.

25. A method as defined in claim 20, further comprising counting the number of rotations of the motor until the piston is fully extended.

26. A method as defined in claim 16, wherein the piston is on a first side of the downhole tool, and a second side of the downhole tool opposite the first side contacts the surface of the wellbore when the piston is extended.

27. A method as defined in claim 16, wherein downhole tool comprises a logging-while-drilling tool.

* * * * *